US008947308B2

(12) United States Patent
Chen et al.

(10) Patent No.: US 8,947,308 B2
(45) Date of Patent: Feb. 3, 2015

(54) METHOD AND APPARATUS FOR CONTROLLING AN ANTENNA

(71) Applicant: Skycross, Inc., Fremont, CA (US)

(72) Inventors: Li Chen, Melbourne, FL (US); Frank M. Caimi, Vero Beach, FL (US); Mark T. Montgomery, Melbourne Beach, FL (US); Paul A. Tornatta, Jr., Melbourne, FL (US)

(73) Assignee: Skycross, Inc., San Jose, CA (US)

( * ) Notice: Subject to any disclaimer, the term of this patent is extended or adjusted under 35 U.S.C. 154(b) by 168 days.

(21) Appl. No.: 13/768,834

(22) Filed: Feb. 15, 2013

(65) Prior Publication Data

US 2013/0229316 A1 Sep. 5, 2013

Related U.S. Application Data

(60) Provisional application No. 61/600,240, filed on Feb. 17, 2012.

(51) Int. Cl.

*H01Q 21/00* (2006.01)
*H01Q 23/00* (2006.01)
*H01Q 1/24* (2006.01)
(Continued)

(52) U.S. Cl.

CPC ..... *H01Q 23/00* (2013.01); *H01Q 1/243* (2013.01); *H01Q 5/0034* (2013.01); *H01Q 5/0062* (2013.01); *H01Q 9/0421* (2013.01)
USPC ..... 343/725; 343/700 MS; 343/702; 343/729; 343/876

(58) Field of Classification Search

CPC ..... H01Q 5/34; H01Q 5/62; H01Q 9/421
USPC ..... 343/700 MS, 702, 725, 729, 876
See application file for complete search history.

(56) References Cited

U.S. PATENT DOCUMENTS 6,104,356 A * 8/2000 Hikuma et al. ..... 343/853
6,753,815 B2 * 6/2004 Okubora et al. ..... 343/700 MS
(Continued)

OTHER PUBLICATIONS

Best, S.R., "A Discussion of the Quality Factor of Electrically Matched Small Wire Antennas," IEEE Trans. Antennas and Propagation, vol. 53, No. 1, pp. 502-508, Jan. 2005.
(Continued)

*Primary Examiner* — Tho G Phan
(74) *Attorney, Agent, or Firm* — Guntin & Gust, PLC; Jay H. Anderson

(57) ABSTRACT

A system that incorporates the subject disclosure may include, for example, a method for coupling a primary antenna to an auxiliary antenna portion with a current-controlled switch. The method further includes generating a unidirectional direct current or a first bias voltage having a first polarity to cause the current-controlled switch to substantially form a conduction channel between the primary antenna and the auxiliary antenna portion. While the conduction channel is present, a first resonance frequency range of the primary antenna is frequency shifted to a second resonance frequency range. The method can also include removing the unidirectional direct current or generating a second bias voltage having a second polarity to cause the current-controlled switch to form an open circuit between the primary antenna and the auxiliary antenna portion. While the open circuit is present, the first resonance frequency range of the primary antenna is restored. Other embodiments are disclosed.

20 Claims, 13 Drawing Sheets

(51) Int. Cl.
*H01Q 5/00* (2006.01)
*H01Q 9/04* (2006.01)

(56) References Cited

U.S. PATENT DOCUMENTS

| | | | | |
|---|---|---|---|---|
| 7,129,894 | B1 * | 10/2006 | Winter | 343/700 MS |
| 7,532,168 | B2 * | 5/2009 | Nakanishi et al. | 343/702 |
| 7,808,445 | B2 * | 10/2010 | von Arbin | 343/876 |
| 7,907,094 | B2 * | 3/2011 | Kakitsu et al. | 343/702 |
| 8,305,275 | B2 * | 11/2012 | Man et al. | 343/702 |
| 8,330,658 | B2 * | 12/2012 | Ishii | 343/702 |

OTHER PUBLICATIONS

Caimi, F.M., "Antenna Solutions for MIMO in LTE Handsets (with other applications)" IWPC MIMO Summit conference proceedings, San Diego, California Nov. 11-12, 2008.

Caimi, F.M., Dual Feed, Single Element Antenna for WiMAX/MIMO Application, International Journal of Antennas and Propagation, v. 2008, Article ID 219838, 2008.

Chiu, C.W., "A Meandered Loop Antenna for LTE/WWAN Operations in a Smartphone," Progress in Electromagnetics Research C, vol. 16, 147{160, 2010.

Chu, L.J., "Physical limitations of omni-directional antennas," Journal Applied Physics 19, pp. 1163-1175, Dec. 1948.

Famdie, Celestin, "Numerical analysis of characteristic modes on the chassis of mobile phones," in EuCAP 2006 1st European Conf. Antennas Propag., Nice, France, Nov. 6-10, 2006, pp. 358-361.

Harrington, R.F., "Effects of Antenna Size on Gain, Bandwidth, and Efficiency," J. Nat. Bur. Stand., v 64-D, pp. 1-12, 1960.

McLean, J.S., "A Re-examination of the Fundamental Limits on the Radiation Q of Electrically Small Antennas," IEEE Antennas and Propagation, vol. 44, pp. 672-675, May 1996.

Vainikainen, P., "Resonator-based analysis of the combination of mobile handset antenna and chassis", IEEE Trans.AP, vol. 50, No. 10, Oct. 2002, 1433-1444.

Vaughan, R.G., "Antenna diversity in mobile communications," IEEE Trans. on Vehicular Technology, vol. 36, No. 4, 149-172, Nov. 1987.

Wheeler, H., "Small Antennas," IEEE Antennas and Propagation, vol. AP-23, 4, pp. 462-469, 1975.

* cited by examiner

METHOD AND APPARATUS FOR CONTROLLING AN ANTENNA

The present application claims the benefit of priority to U.S. Provisional Application No. 61/600,240 filed on Feb. 17, 2012, which is hereby incorporated herein by reference in its entirety.

FIELD OF THE DISCLOSURE

The subject disclosure relates to a method and apparatus for controlling an antenna.

BACKGROUND

The trend in mobile wireless devices has been to provide faster access, improved processors, more memory, brighter and higher resolution screens, additional connectivity with Wi-Fi, GPS, 3G and 4G world access—all with longer battery life in thinner more sleek packages. Compound this with the desire of mobile operators to expand their available band allocations, and what results is a difficult industrial design arena, where suppliers are vying for physical space within the confines of a smartphone or similar device to accommodate necessary components. One such component is the antenna—essentially a transducer that converts time varying electrical current to radiated energy, and often considered a last minute addition to the physical structure.

BRIEF DESCRIPTION OF THE DRAWINGS

Reference will now be made to the accompanying drawings, which are not necessarily drawn to scale, and wherein.

DETAILED DESCRIPTION

Figure 1:
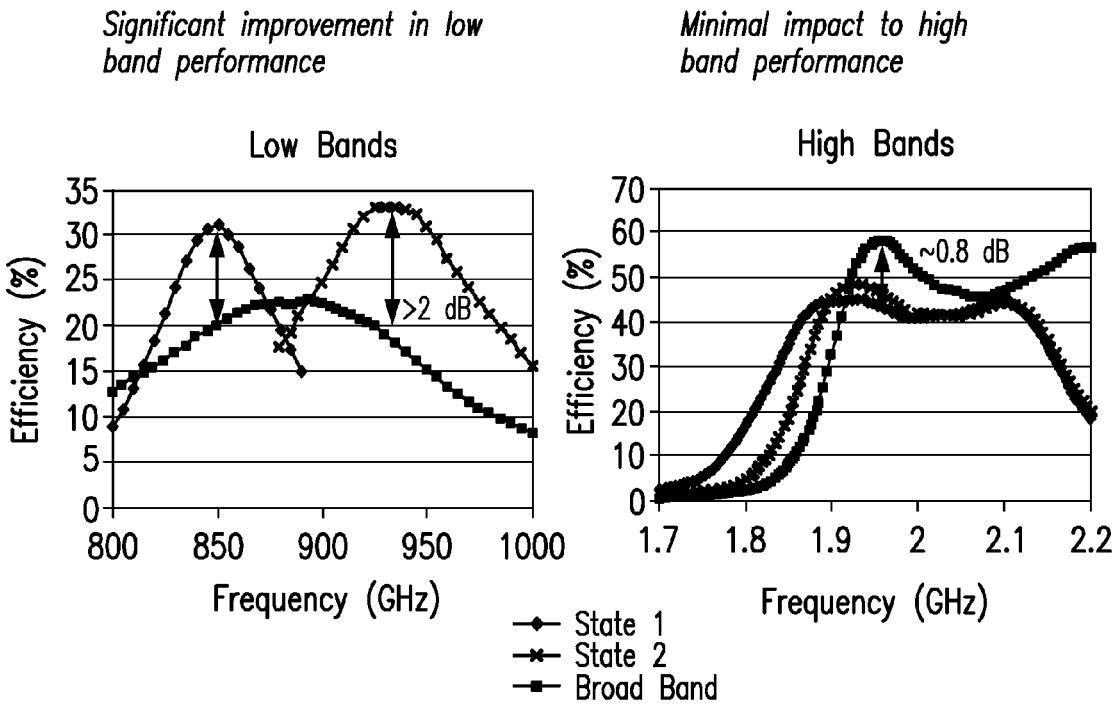
FIG. 1 depicts an illustrative embodiment of frequency plots for a single low band-multiple high band aggregation of an antenna.

The subject disclosure describes, among other things, illustrative embodiments of an antenna with a controllable resonance. Other embodiments are included in the subject disclosure.

One embodiment of the subject disclosure includes an antenna structure having a primary antenna portion, and an auxiliary antenna portion. A portion of the primary antenna portion can operate at a first resonance frequency. The auxiliary antenna portion can be coupled to the primary antenna portion by way of a current-controlled switch, which can be coupled to a source. The current-controlled switch can be coupled to the primary antenna portion and to the auxiliary antenna portion. range. In one state of operation, the current-controlled switch substantially forms a conduction channel between the primary antenna portion and the auxiliary antenna portion responsive to the current-controlled switch receiving from the source a unidirectional direct current or a first bias voltage having a first polarity. When the conduction channel is present, the first resonance frequency range of the primary antenna portion is frequency shifted to a second resonance frequency range. In another state of operation, the current-controlled switch substantially forms an open circuit between the primary antenna portion and the auxiliary antenna portion responsive to the source removing the unidirectional direct current applied to the current-controlled switch or the source applying to the current-controlled switch a second bias voltage having a second polarity. When the open circuit is present, the first resonance frequency range of the primary antenna portion is restored.

One embodiment of the subject disclosure includes a method for coupling a primary antenna to an auxiliary antenna portion with a current-controlled switch. The method further includes generating a unidirectional direct current or a first bias voltage having a first polarity to cause the current-controlled switch to substantially form a conduction channel between the primary antenna and the auxiliary antenna portion. While the conduction channel is present, a first resonance frequency range of the primary antenna is frequency shifted to a second resonance frequency range. The method can also include removing the unidirectional direct current or generating a second bias voltage having a second polarity to cause the current-controlled switch to form an open circuit between the primary antenna and the auxiliary antenna portion. While the open circuit is present, the first resonance frequency range of the primary antenna is restored.

One embodiment of the subject disclosure includes a communication device having an antenna structure that includes a primary antenna portion, an auxiliary antenna portion, a switch coupled to a signal source, wherein the switch conducts only unidirectional current, and wherein the primary antenna portion is coupled to the auxiliary antenna portion by way of the switch. The communication device further comprises a memory to store instructions, and a processor coupled to the signal source, and the memory. Responsive to executing the instructions, the processor performs operations including causing the signal source to generate a first signal that causes the switch to substantially form a first conduction channel between the primary antenna portion and the auxiliary antenna portion. While the first conduction channel is present, the first low band resonance frequency range of the primary antenna portion is frequency shifted to a second low band resonance frequency range. The processor further performs operations including causing the signal source to generate a second signal that causes the switch to form an first open circuit between the primary antenna portion and the auxiliary antenna portion. While the first open circuit is present the first low band resonance frequency range of the primary antenna portion is restored.

A number of factors affect antenna performance in a portable communication device, such as a hand held mobile communication device. While these factors are related, they generally fall into one of three categories: antenna size, mutual coupling between multiple antennas, and device usage models.

The size of an antenna can be dependent on three criteria: bandwidth of operation, frequency of operation, and required radiation efficiency. Bandwidth requirements have increased as they are driven by FCC frequency allocations in the US and carrier roaming agreements around the world. Different regions use different frequency bands. For example, there are now over 40 E-UTRA band designations-many overlapping and requiring world capable wireless devices to typically cover a frequency range from 698 to 2700 MHz.

A simple relationship exists between the bandwidth, size, and radiation efficiency of the fundamental or lowest frequency resonance of a physically small antenna.

$$\frac{\Delta f}{f} \propto \left(\frac{a}{\lambda}\right)^3 \eta^{-1} \tag{1}$$

The variable $\alpha$ represents the radius of a sphere containing the antenna and its associated current distribution. Since $\alpha$ is normalized to the operating wavelength $\lambda$, the formula may be interpreted as "fractional bandwidth being proportional to the wavelength normalized modal volume." The radiation efficiency $\eta$ is included as a factor on the right side of equation (1), indicating that greater bandwidth is achievable by reducing the efficiency. Radio frequency currents exist not only on an antenna element but also on an attached conductive structure or "counterpoise". For instance, mobile phone antennas in the 700-960 MHz bands can use an entire printed circuit board (PCB) as a radiating structure so that the physical size of the antenna according to equation (1) is actually much larger than what appears to be the "antenna". The "antenna" may be considered a resonator that is electromagnetically coupled to the PCB so that it excites currents over the entire conductive structure or chassis.

Most smartphones exhibit conductive chassis dimensions of approximately 60×110 mm, which according to an electromagnetic modal analysis predicts a fundamental mode somewhat over 1 GHz suggesting that performance bandwidth degrades progressively at lower excitation frequencies. The efficiency-bandwidth trade-off is complex requiring E-M simulation tools for accurate prediction. Results indicate that covering 698-960 MHz (Bands 12, 13, 17, 18, 19, 20, 5 and 8) with a completely passive antenna with desirable antenna size and geometry becomes difficult without making sacrifices in radiation efficiency.

Factors determining the achievable radiation efficiency are not entirely obvious, as the coupling coefficient between the "antenna" and the chassis, radiative coupling to lossy components on the PCB, dielectric absorption in plastic housing, coupling to co-existing antennas, as well as losses from finite resistance within the "antenna" resonator structure, can all play a part. In most cases, the requirements imposed by operators suggest minimum radiation efficiencies of 40-50%, so that meeting a minimum Total Radiated Power (TRP) requirement essentially requires tradeoffs between a power amplifier (PA) output and achievable antenna efficiency. In turn, poor efficiency at the antenna translates to less battery life, as the PA must compensate for the loss.

Prior to a migration towards band aggregation, wireless devices operated on one band at a time with need to change when roaming. Consequently, the required instantaneous bandwidth would be considerably less than that required to address worldwide compatibility. Take a 3G mobile phone for example, where operation in band 5 from (824-894 MHz) compared to operation in bands 5 plus 8 (824-960 MHz). Now add the requirements for band 13 and band 17 and the comparison becomes more dramatic: 824-960 vs. 698-960 MHz.

Band aggregation becomes even more problematic as legacy phone antennas support pentaband operation, and only bands 5 and 8. Given the implications of equation (1) several choices exist. The most obvious would be to increase the antenna system size, (i.e., the antenna and phone chassis footprint) and/or to reduce the radiation efficiency. Since 4G smartphones require 2 antennas, neither approach is desirable from an industrial design standpoint, although it is possible to cover the 700-2200 MHz bands with a completely passive antenna in a space allocation of 6.5×10×60 mm.

Various alternative antenna configurations can be considered:

- Limit the antenna(s) instantaneous bandwidth within current antenna space allocations to allow use of one or more antennas without compromising the industrial design (an Antenna Supplier motivation);
- Make the antenna(s) smaller to achieve a compact and sleek device with greater functionality by limiting the instantaneous bandwidth with same or improved antenna efficiency (an Original Equipment Manufacturer—OEM motivation);
- Improve the antenna efficiency, and therefore the network performance by controlling the antenna instantaneous frequency/tuning (an Operator motivation);
- Make the antenna agile to adapt to different usage models (a combined OEM/User/Operator motivation); or
- Combinations of the above.

The simplest approach can be to limit the instantaneous operation to a single band to satisfy the protocol requirements for a single region. To satisfy the roaming requirements, the antenna could be made frequency agile on a band-by-band basis. This approach represents the most basic type of "state-tuned" antenna.

An illustration of the performance gain achievable with state-tuning is described in the subject disclosure using a 3G mobile phone manufactured with legacy multiband antenna covering low frequency bands 5 and 9 (824-960 MHz), as well as high frequency bands 1 and 2 (1850-2170 MHz). As shown in FIG. 1, sub-standard radiation efficiencies of 15 to 23% were measured across the low band frequency range. A retrofit of the phone antenna using a 2-state tuning method to separately cover bands 5 and 9 achieved measured performance gains of up to 2 dB without changing the antenna size or location.

Since typical antennas used in mobile devices are not just single mode resonators, they can support simultaneous high band operation, allowing for carrier (band) aggregation depending on the aggregation plan and the specifics of the antenna design.

The subject disclosure presents embodiments for an antenna structure that overcomes the above noted limitations. An embodiment of the subject disclosure allows for: (1) Tuning of a first resonance of an antenna to accommodate multiple operational bands depending on the tuning state, and (2) Broadband operation on the high band (band 4, 1710-2155 MHz) independent of the low band tuning state.

In one embodiment of the subject disclosure, an antenna can be configured for:

Two State tuning in the low band
- State 1: GSM 900 diode on
- State 2: CDMA 800 diode off Low band: without tuning, is similar to the one state switch solution—using tuning, the bandwidth is effectively doubled in the low band High band: Used in diode ON state. Up to 10% better for both CDMA 1900 and WCDMA 2100

The embodiment shown in FIG. 1 is illustrative of a single low band-multiple high band aggregation antenna. The high band radiation efficiency in one embodiment remains essentially the same independent of the low band tuning state.

One embodiment of the subject disclosure can employ a multiband antenna having two low band tuning states as shown in FIG. 1 (left side). State 1 illustrates a low band resonance suited for GSM850 (824-894 MHz)) operation. State 2 illustrates a low band resonance suited to GSM 900 (880-960 MHz) operation.

The high band resonance (1850-2170 MHz) is reasonably independent of the tuning state for the low band by nature of the method used in tuning the low band resonator of the antenna. The antenna can incorporate a main structure that has a fundamental and first harmonic resonance at the low and high bands, respectively. The high band resonance of the main structure can be augmented by an adjacent parasitic resonator structure that is tuned to broaden the first harmonic ($2^{nd}$) resonance of the main structure.

Low band tuning is accomplished by switching from a series radio frequency (RF) current path to a parallel RF current path in the main structure of the antenna. The parallel path by nature of its reduced inductance increases the fundamental resonant frequency of the main structure.

Tuning can be accomplished using a switching device capable of a single pole single throw (SPST) operation. In one embodiment, the switching device can be a PIN diode switch. The PIN diode can attain an open or closed state exemplified by a high or low impedance, respectively.

Figure 2:
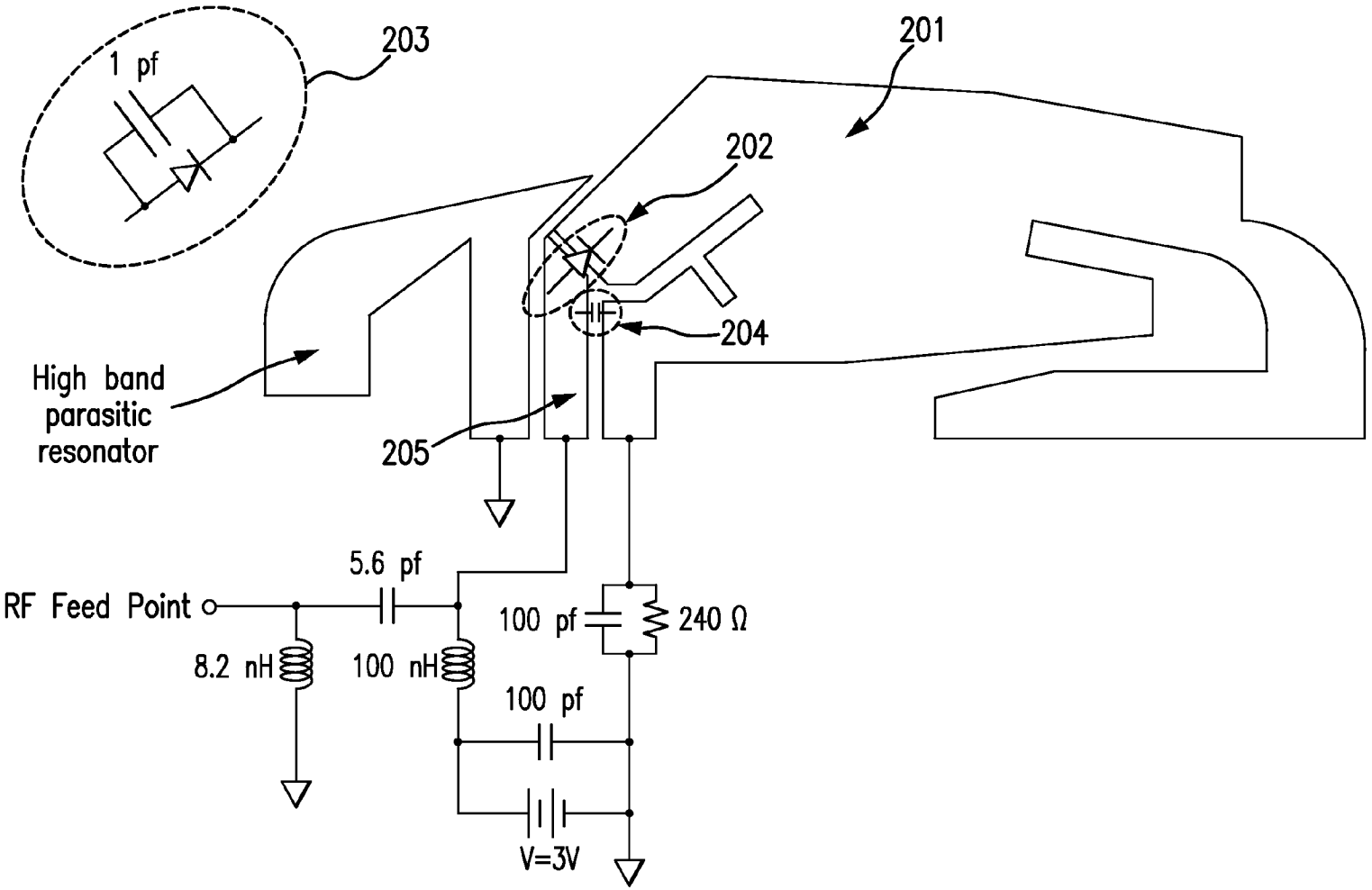
FIG. 2 depicts an illustrative embodiment of an antenna of the subject disclosure.
Figure 3:
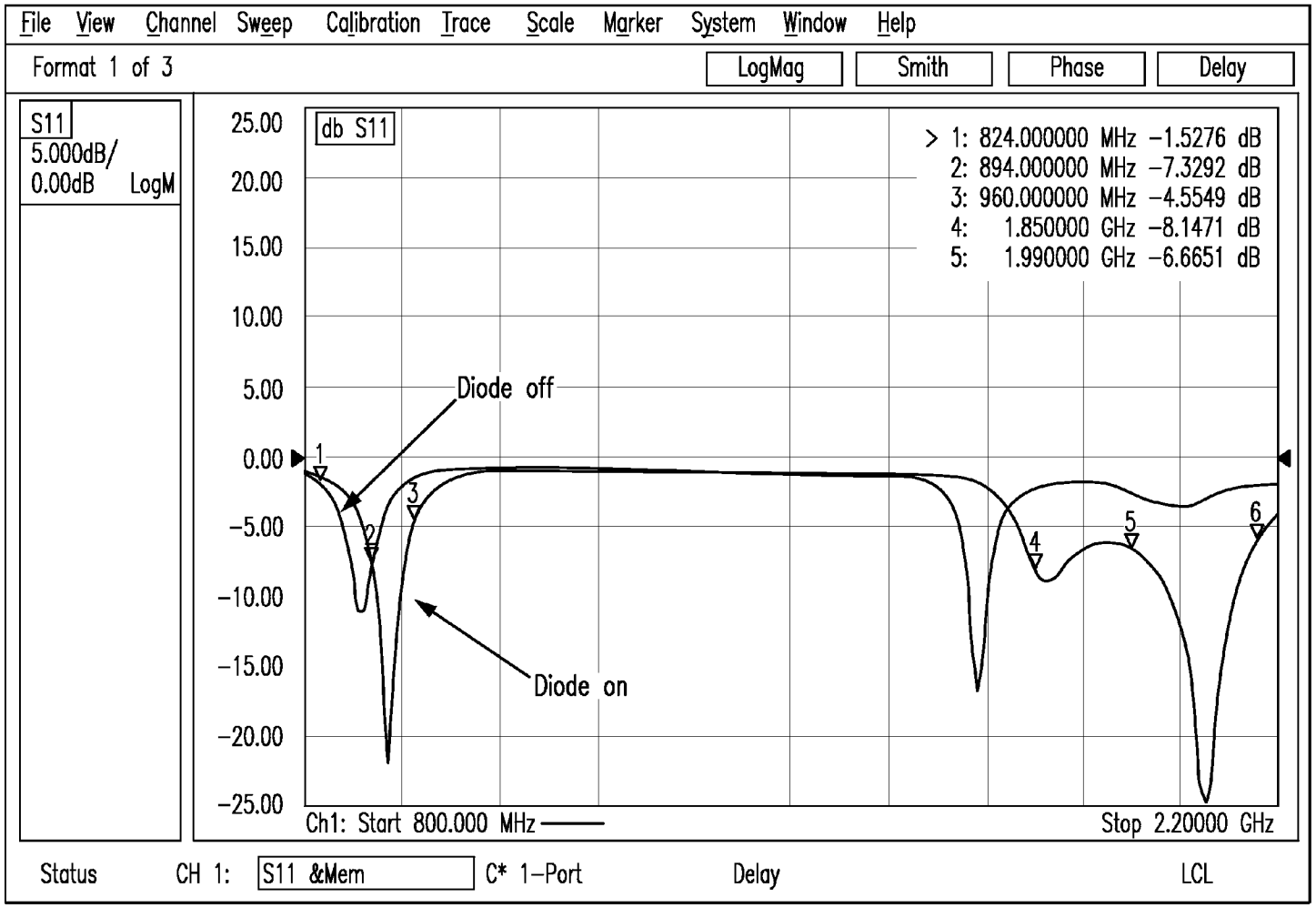
FIG. 3 depicts an illustrative embodiment of a return loss frequency plot based on a two state operation of the diode.
Figure 4:
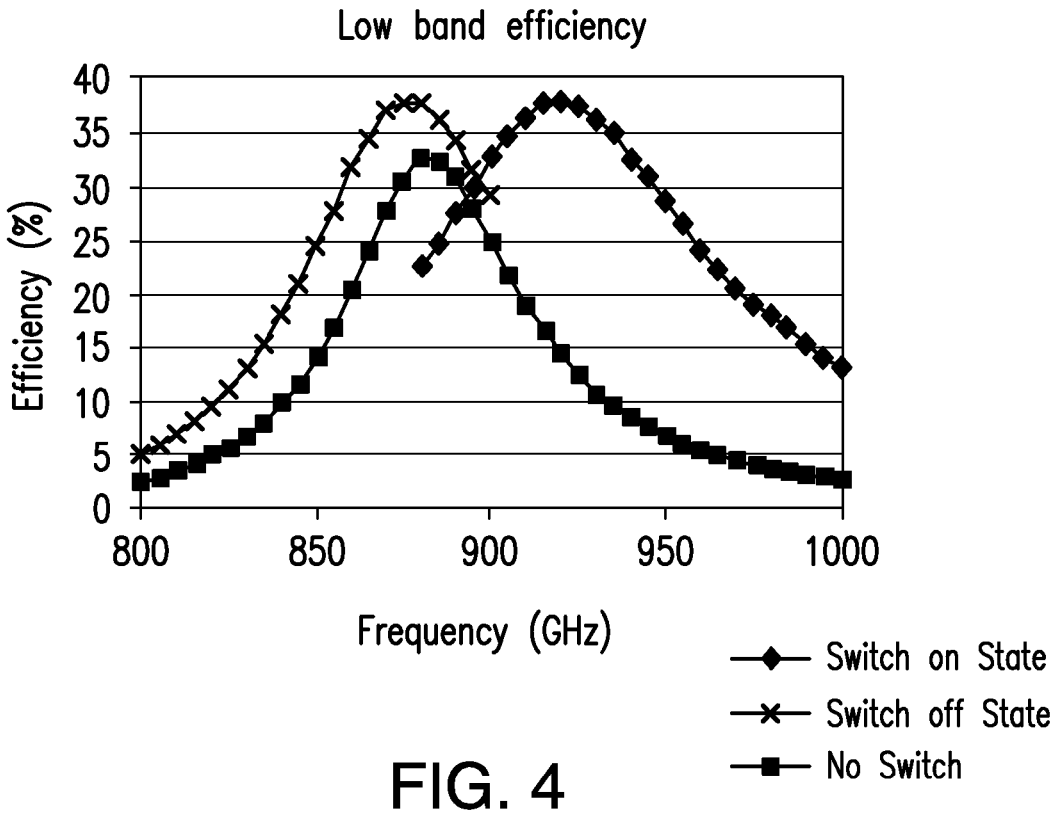
FIG. 4 depicts an illustrative embodiment of a frequency plot of a low band efficiency of the antenna.
Figure 5:
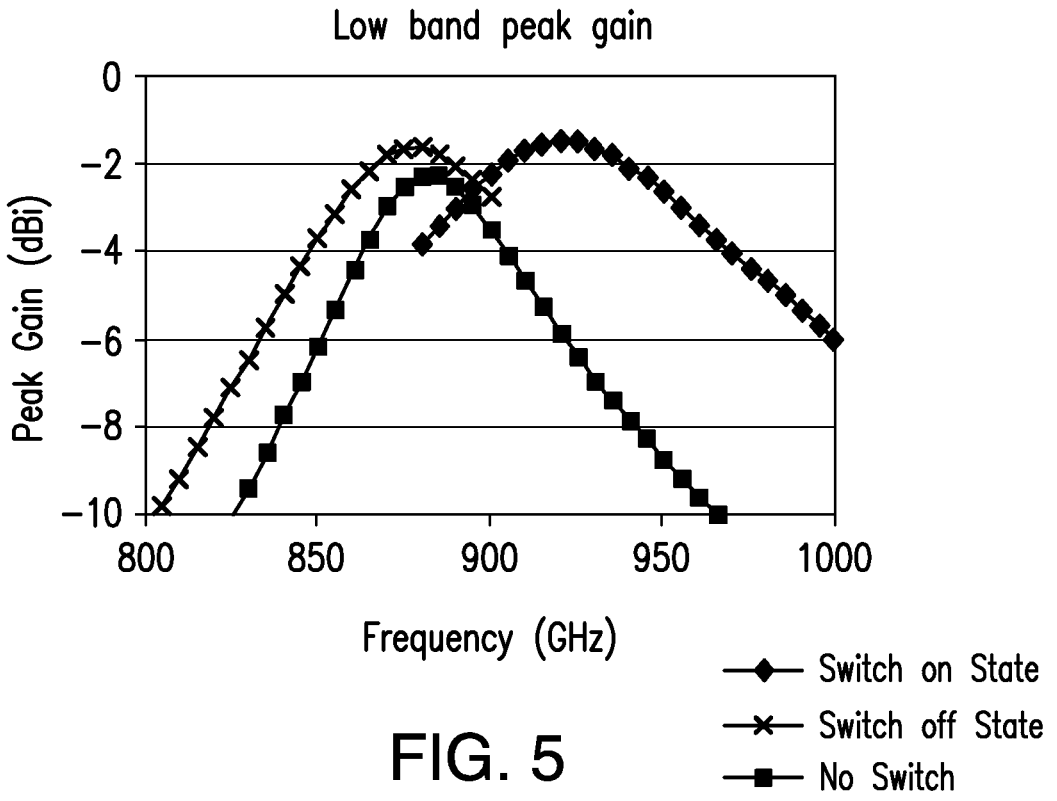
FIG. 5 depicts an illustrative embodiment of a frequency plot of a low band peak gain of the antenna.

The antenna shown in FIG. 2 can be switched to a different low band resonance as follows. When 3 volts (V) is applied to the circuit as shown, the PIN diode 202 is biased "ON" and conducts current in the forward direction, thereby creating a conduction channel that connects a primary antenna portion 201 to an auxiliary antenna portion 205. The resonance frequency of the primary antenna portion 201 is frequency shifted as a result of electrically extending the primary antenna portion 201 by the auxiliary antenna portion 205 when the conduction channel is present as shown in FIGS. 3-5. Radio frequency (RF) signals are transmitted into or received from the primary antenna portion 201 by way of an RF capacitor 204 coupled between the primary antenna portion 201 and the auxiliary antenna portion 205. Such RF signals originate or terminate at the RF feed point. The 100 nH inductor isolates the RF circuit from the control circuit consisting of the 3V power supply. A 100 pF capacitor is shunted across the 3V power supply to bypass any residual RF current to the common ground. The DC bias current is limited by the 240-ohm resistor, according to the loop voltage equation: V++=Vdiode+Ibias*240 ohms. The 100nH inductor is assumed to have negligible resistance. Increasing the bias current generally lowers the on-resistance of the PIN diode 202 allowing for a low-loss switching action, which reduces the harmonic generation. The PIN diode 202 assumes an "OFF" state when the voltage is removed, set to zero, or reversed. A reverse bias voltage can be used to reduce the non-linearity effects exhibited by the PIN diode 202, thereby reducing production of harmonics by the antenna (e.g., IP3, IP2, etc.). To further reduce harmonics, a 1 pF capacitor can be coupled to the PIN diode in parallel as shown by reference 203. Diodes selected for lowest IP3 in reverse bias operation can have thick intrinsic layers, and exhibit small second derivative of reverse capacitance with respect to applied reverse bias voltage. IP3 increases with increasing frequency. Infineon™ PIN diode models BAR64 or BA595/585 can be well suited to this application.

Figure 6:
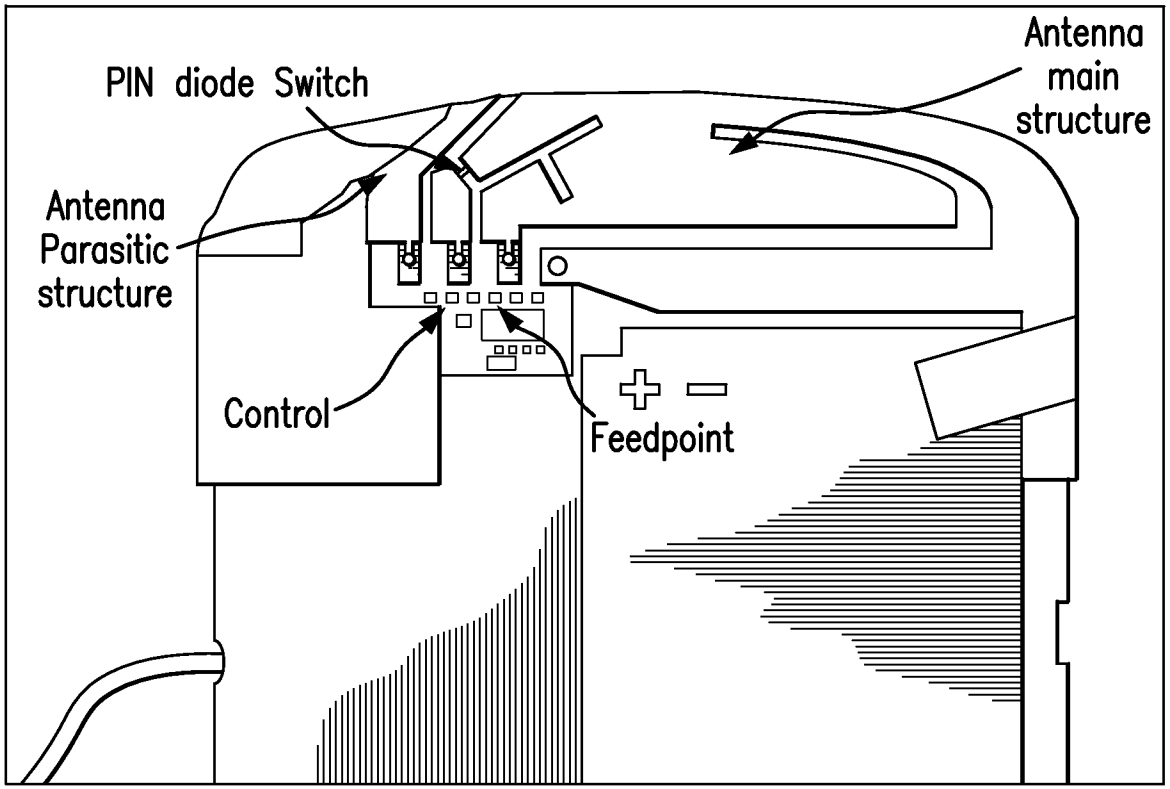
FIG. 6 depicts an illustrative embodiment of the antenna of the subject disclosure incorporated into a communication device.

FIG. 3 depicts an illustrative embodiment of a return loss frequency plot based on a two state operation of the diode described above. FIG. 4 depicts an illustrative embodiment of a frequency plot of a low band efficiency of the antenna. FIG. 5 depicts an illustrative embodiment of a frequency plot of a low band gain of the antenna. FIG. 6 depicts an illustrative embodiment of the antenna of the subject disclosure utilized by a communication device such as a mobile phone or other suitable communication device.

Figure 7:
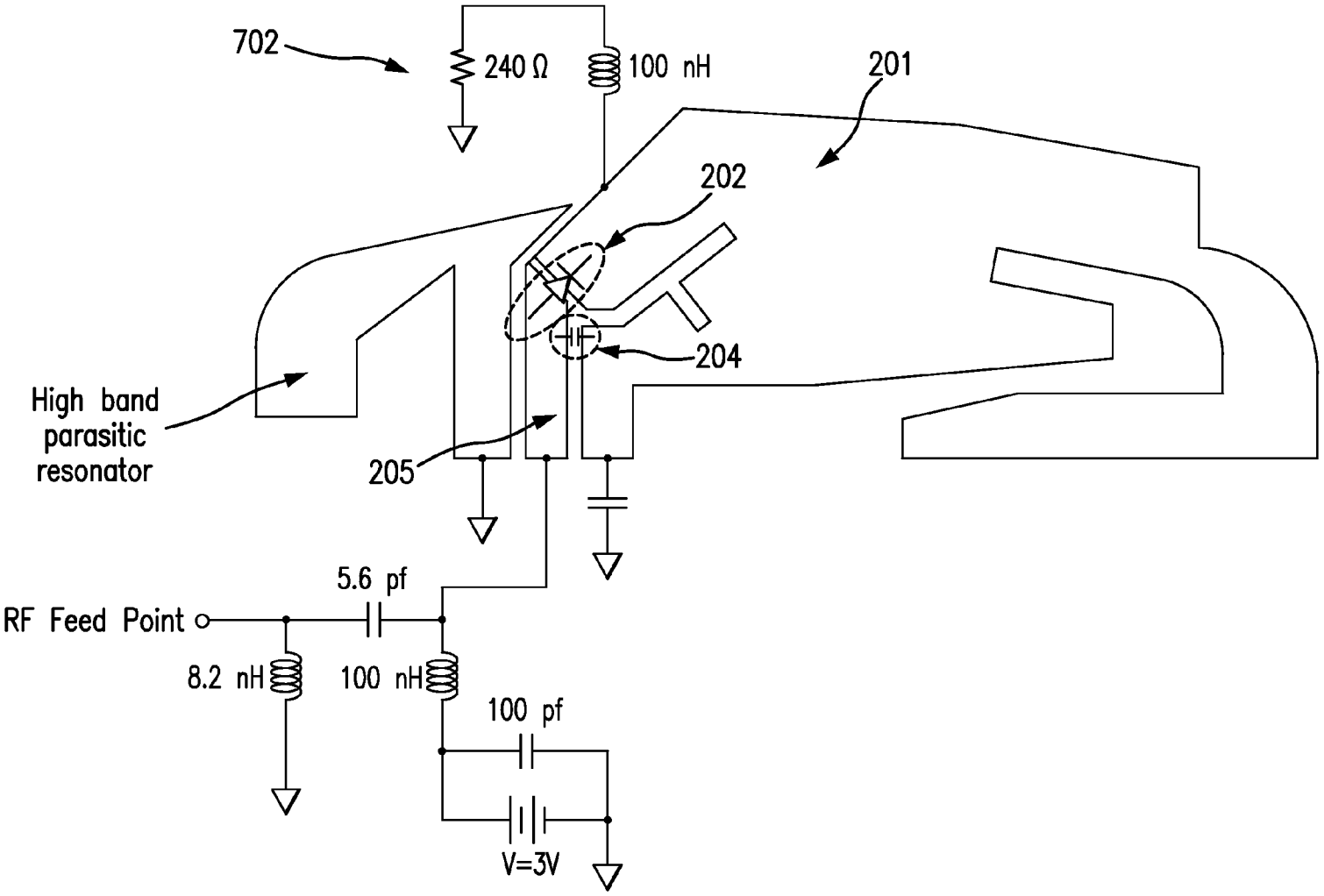
FIGS. 7-8 depict illustrative embodiments of other antenna configurations of the subject disclosure.
Figure 8:
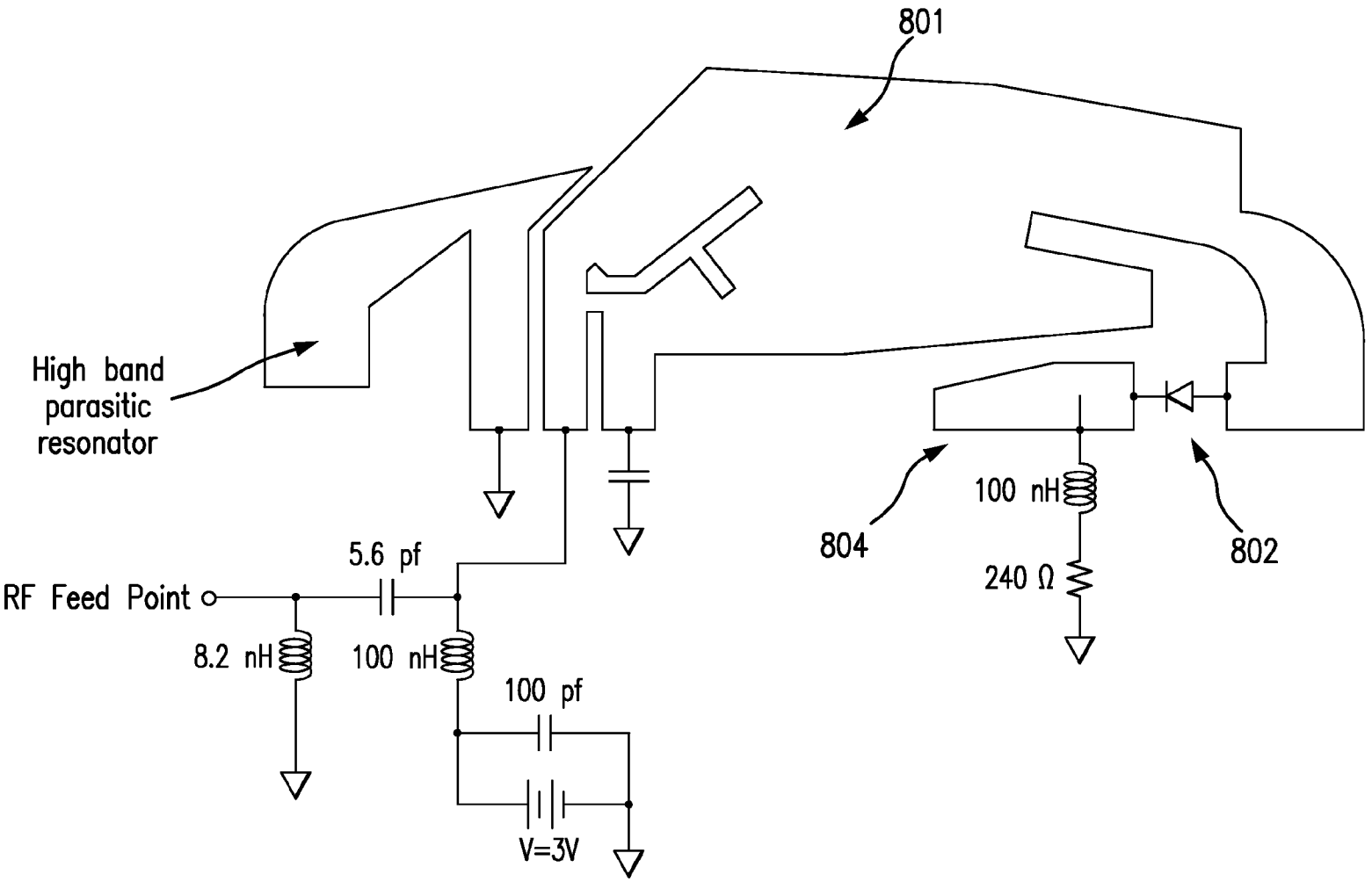

FIGS. 7-8 depict illustrative embodiments of other antenna configurations of the subject disclosure. For the embodiment of the antenna shown in FIG. 7, a DC return circuit 702 is located in close proximity to a cathode of the diode in order to reduce the RF current or voltage induction in a bias circuit. In another embodiment, both the current source point and sink point can be located directly below the PIN diode. The drive circuit can then be placed on a PCB below the antenna. Both inductors would be attached to the antenna near the anode and cathode of the PIN diode. The bias voltage circuitry would be embedded in the PCB with a ground plane above and below to shield the bias leads from current or voltage induction by the antenna RF currents. This can improve efficiency of the antenna and reduce harmonic content.

Figure 9:
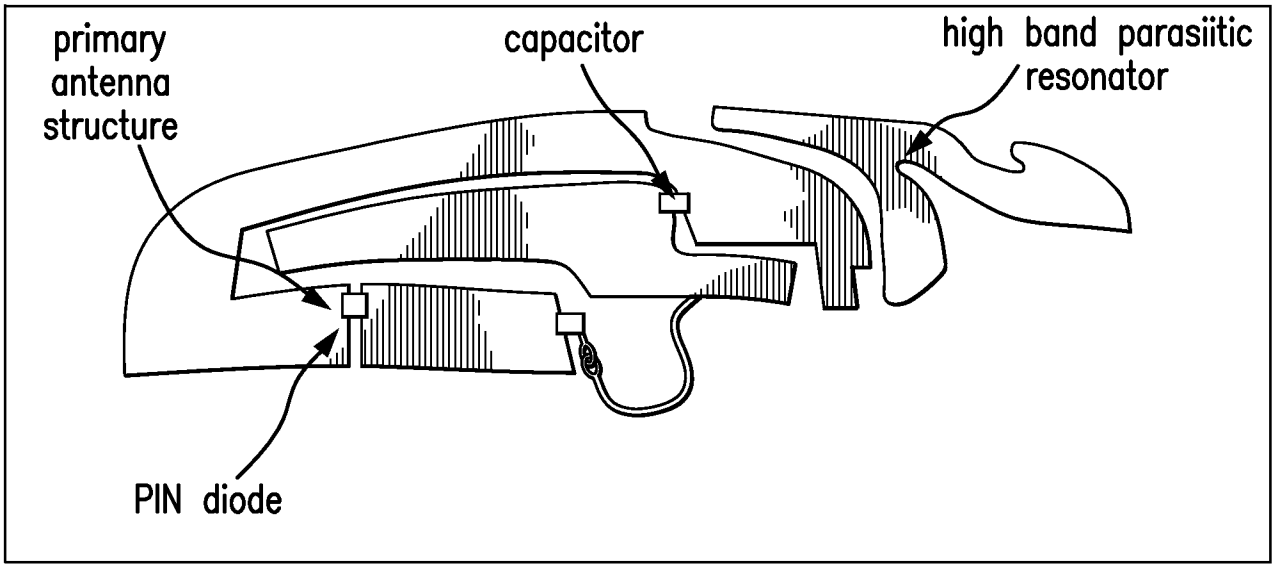
FIGS. 9-10 depict illustrative embodiments of the antenna of FIG. 8.
Figure 10:
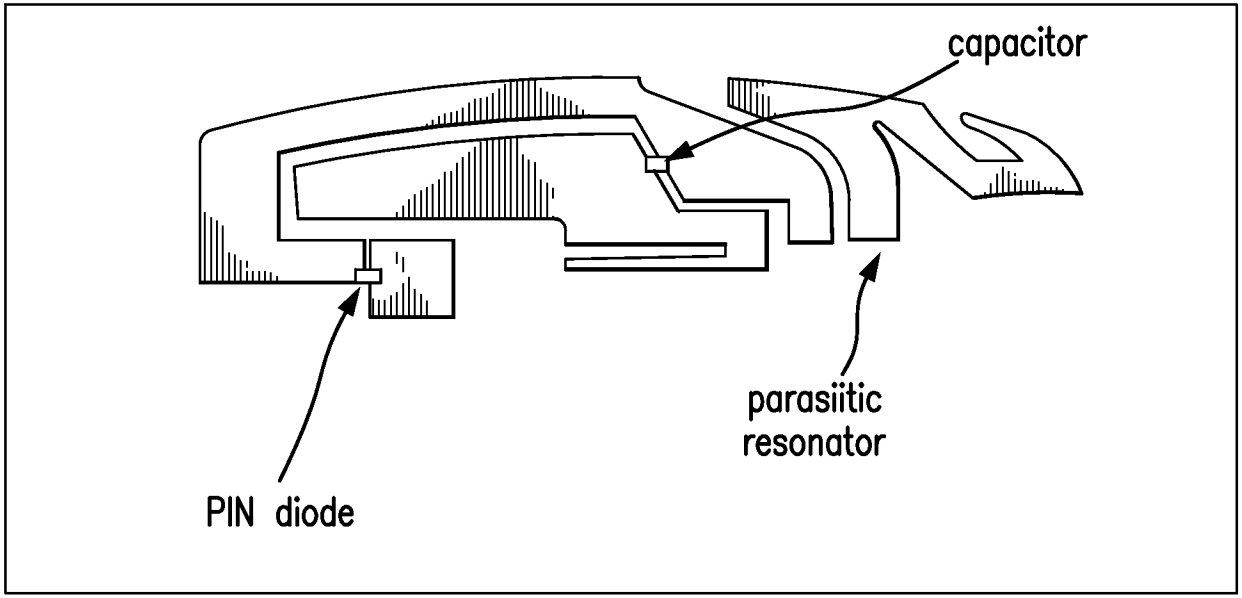

In the antenna embodiment shown in FIG. 8, the PIN diode switch 802 is located further out on a low band arm of the antenna. In the embodiment of FIG. 8, the auxiliary antenna portion 205 and the primary antenna portion 201 of FIGS. 2 and 7 are connected to form a new primary antenna portion 801. A new auxiliary antenna portion 804 is placed near the low band arm. In this embodiment, the high band is more independent of the low band tuning state. The antenna configurations shown in FIGS. 9-10 depict illustrative prototype embodiments of mirror images of the antenna of FIG. 8.

Figure 11:
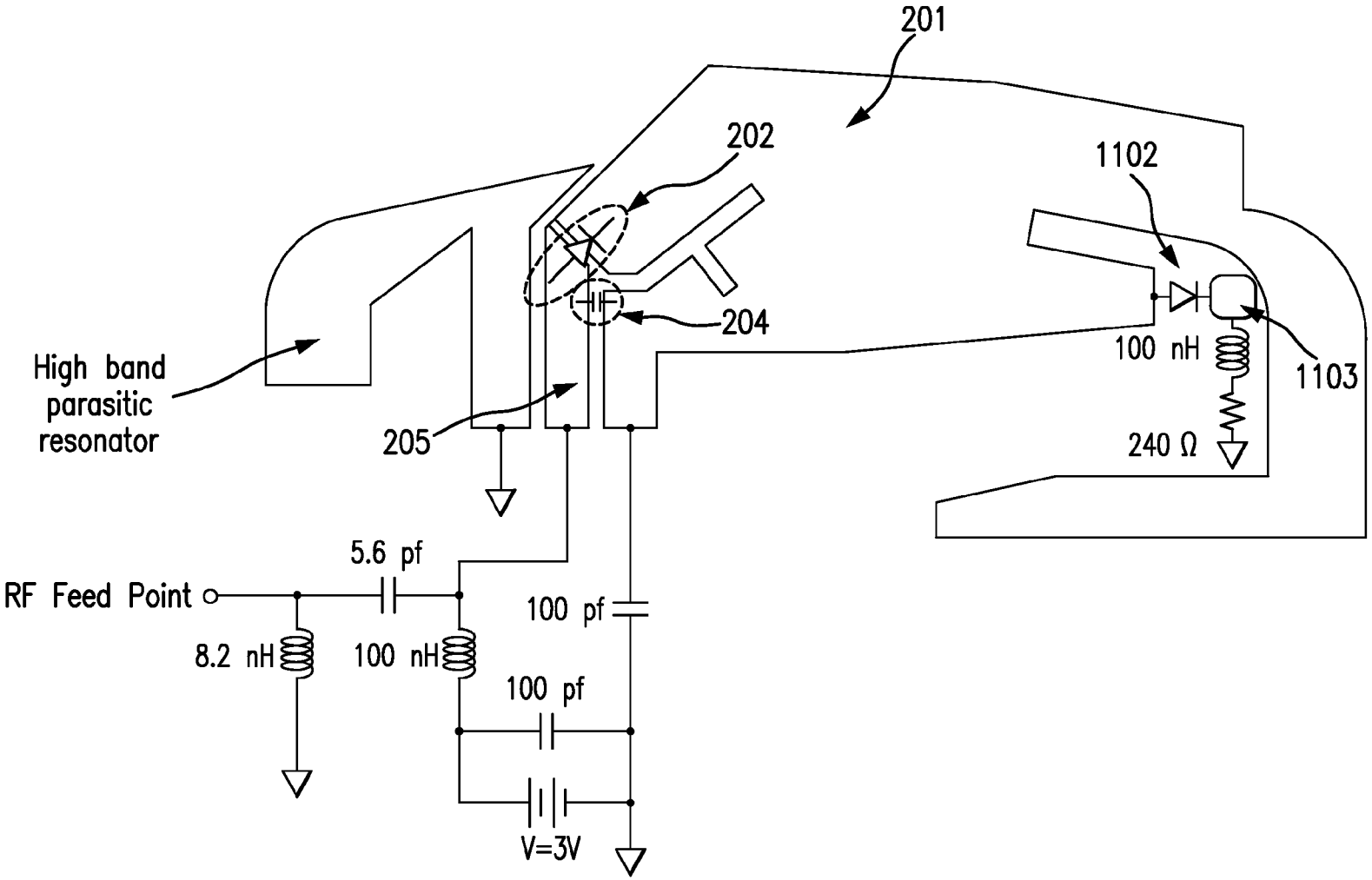
FIG. 11 depicts an illustrative embodiment of another antenna structure of the subject disclosure.

FIG. 11 depicts an illustrative embodiment of another antenna structure of the subject disclosure. In this embodiment, the antenna configuration of FIG. 7 is used with a second PIN diode switch 1102 located on a high band arm of the antenna. The second PIN diode 1102 is coupled between the high band arm a second auxiliary antenna portion 1103 that is in turn coupled to an inductor and resistor to ground. When the first PIN diode 202 used for controlling tuning of the low band arm is in the "ON" state, a DC bias current flowing from the low band arm feeds the second PIN diode 1102 of the high band arm thereby electrically extending the length of the high band arm according to the auxiliary antenna portion 1103. The electrical extension of the high band arm in turn frequency shifts the high band resonance of the antenna providing for two-state tunability of the high band arm. With this embodiment, the antenna structure of FIG. 11 can provide low band or high band tuning options for a multimode antenna design.

It should be noted that the antenna configurations shown in FIGS. 2 and 6-11 can be modified in multiple ways to achieve the tunability features described above. For example, the 3V signal source can be replaced by a controllable variable voltage or current source. The antenna structures shown can differ so as to achieve other resonance properties. Accordingly, the embodiments described in the subject disclosure can be adapted in multiple ways to achieve a tunable antenna operation. Such embodiments are contemplated by the subject disclosure.

Figure 12:
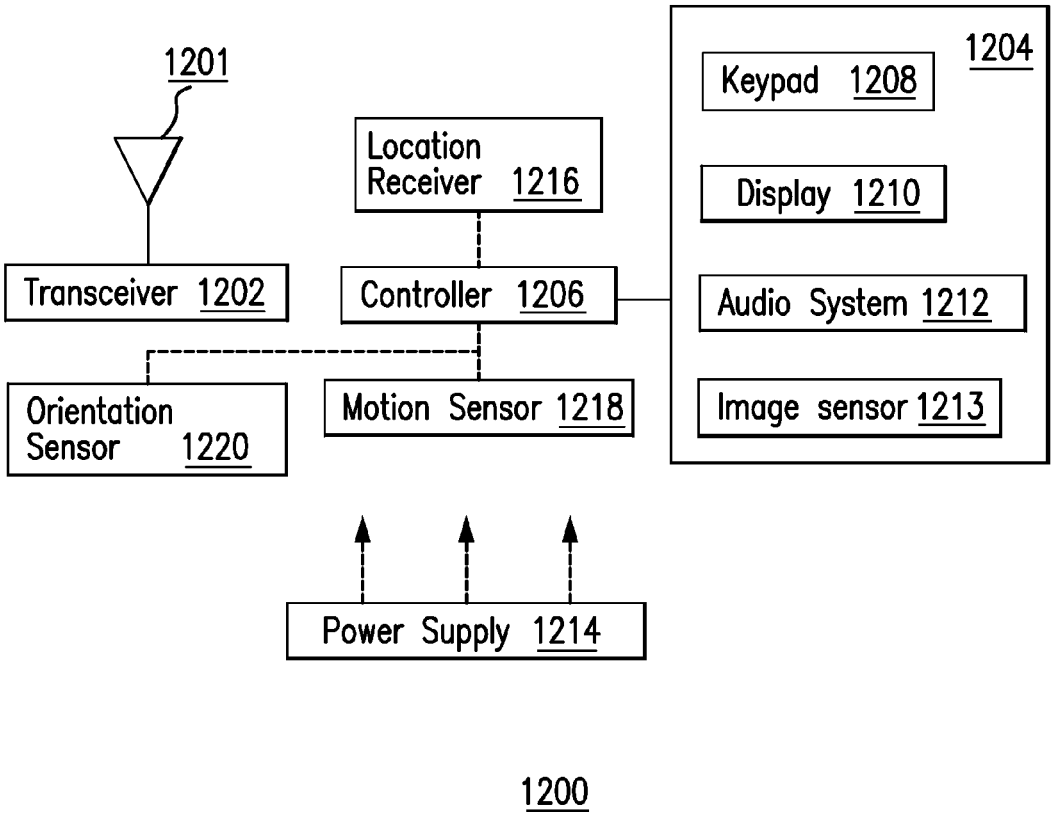
FIG. 12 depicts an illustrative embodiment of a communication device that utilizes any one of the antenna structures of the subject disclosure.

FIG. 12 depicts an illustrative embodiment of a communication device 1200 that utilizes any of the embodiments of the antenna structure of the subject disclosure. The communication device 1200 can comprise a wireless transceiver 1202 (herein transceiver 1202), a user interface (UI) 1204, a power supply 1214, a location receiver 1216, a motion sensor 1218, an orientation sensor 1220, and a controller 1206 for managing operations thereof. The transceiver 1202 can support short-range or long-range wireless access technologies such as Bluetooth, ZigBee, WiFi, DECT, or cellular communication technologies, just to mention a few. Cellular technologies can include, for example, CDMA-1X, UMTS/HSDPA, GSM/GPRS, TDMA/EDGE, EV/DO, WiMAX, SDR, LTE, as well as other next generation wireless communication technologies as they arise. The transceiver 1202 is coupled to antenna 1201 which can utilize any of the tunable structures described above, thereby enabling the transceiver 1202 to operate and control a tunable low band, a tunable high band, or combined tunable bands of the antenna 1201.

The UI 1204 can include a depressible or touch-sensitive keypad 1208 with a navigation mechanism such as a roller ball, a joystick, a mouse, or a navigation disk for manipulating operations of the communication device 1200. The keypad 1208 can be an integral part of a housing assembly of the communication device 1200 or an independent device operably coupled thereto by a tethered wireline interface (such as a USB cable) or a wireless interface supporting for example Bluetooth. The keypad 1208 can represent a numeric keypad commonly used by phones, and/or a QWERTY keypad with alphanumeric keys. The UI 1204 can further include a display 1210 such as monochrome or color LCD (Liquid Crystal Display), OLED (Organic Light Emitting Diode) or other suitable display technology for conveying images to an end user of the communication device 1200. In an embodiment where the display 1210 is touch-sensitive, a portion or all of the keypad 1208 can be presented by way of the display 1210 with navigation features.

The display 1210 can use touch screen technology to also serve as a user interface for detecting user input. As a touch screen display, the communication device 1200 can be adapted to present a user interface with graphical user interface (GUI) elements that can be selected by a user with a touch of a finger. The touch screen display 1210 can be equipped with capacitive, resistive or other forms of sensing technology to detect how much surface area of a user's finger has been placed on a portion of the touch screen display. This sensing information can be used to control the manipulation of the GUI elements or other functions of the user interface. The display 1210 can be an integral part of the housing assembly of the communication device 400 or an independent device communicatively coupled thereto by a tethered wireline interface (such as a cable) or a wireless interface.

The UI 1204 can also include an audio system 1212 that utilizes audio technology for conveying low volume audio (such as audio heard in proximity of a human ear) and high volume audio (such as speakerphone for hands free operation). The audio system 1212 can further include a microphone for receiving audible signals of an end user. The audio system 1212 can also be used for voice recognition applications. The UI 1204 can further include an image sensor 1213 such as a charged coupled device (CCD) camera for capturing still or moving images.

The power supply 1214 can utilize common power management technologies such as replaceable and rechargeable batteries, supply regulation technologies, and/or charging system technologies for supplying energy to the components of the communication device 1200 to facilitate long-range or short-range portable applications. Alternatively, or in combination, the charging system can utilize external power sources such as DC power supplied over a physical interface such as a USB port or other suitable tethering technologies.

The location receiver 1216 can utilize location technology such as a global positioning system (GPS) receiver capable of assisted GPS for identifying a location of the communication device 1200 based on signals generated by a constellation of GPS satellites, which can be used for facilitating location services such as navigation. Antenna 1201 or another separate antenna (not shown) can be used for the GPS receiver. The motion sensor 1218 can utilize motion sensing technology such as an accelerometer, a gyroscope, or other suitable motion sensing technology to detect motion of the communication device 1200 in three-dimensional space. The orientation sensor 1220 can utilize orientation sensing technology such as a magnetometer to detect the orientation of the communication device 1200 (north, south, west, and east, as well as combined orientations in degrees, minutes, or other suitable orientation metrics).

The controller 1206 can utilize computing technologies such as a microprocessor, a digital signal processor (DSP), programmable gate arrays, application specific integrated circuits, and/or a video processor with associated storage memory such as Flash, ROM, RAM, SRAM, DRAM or other storage technologies for executing computer instructions, controlling, and processing data supplied by the aforementioned components of the communication device 400.

The communication device 400 can also include a slot for adding or removing an identity module such as a Subscriber Identity Module (SIM) card. SIM cards can be used for identifying subscriber services, executing programs, storing subscriber data, and so forth. It is further noted that the communication device 1200 can operate with more or fewer of the circuit components shown in FIG. 12. These variant embodiments can be used in one or more embodiments of the subject disclosure.

Figure 13:
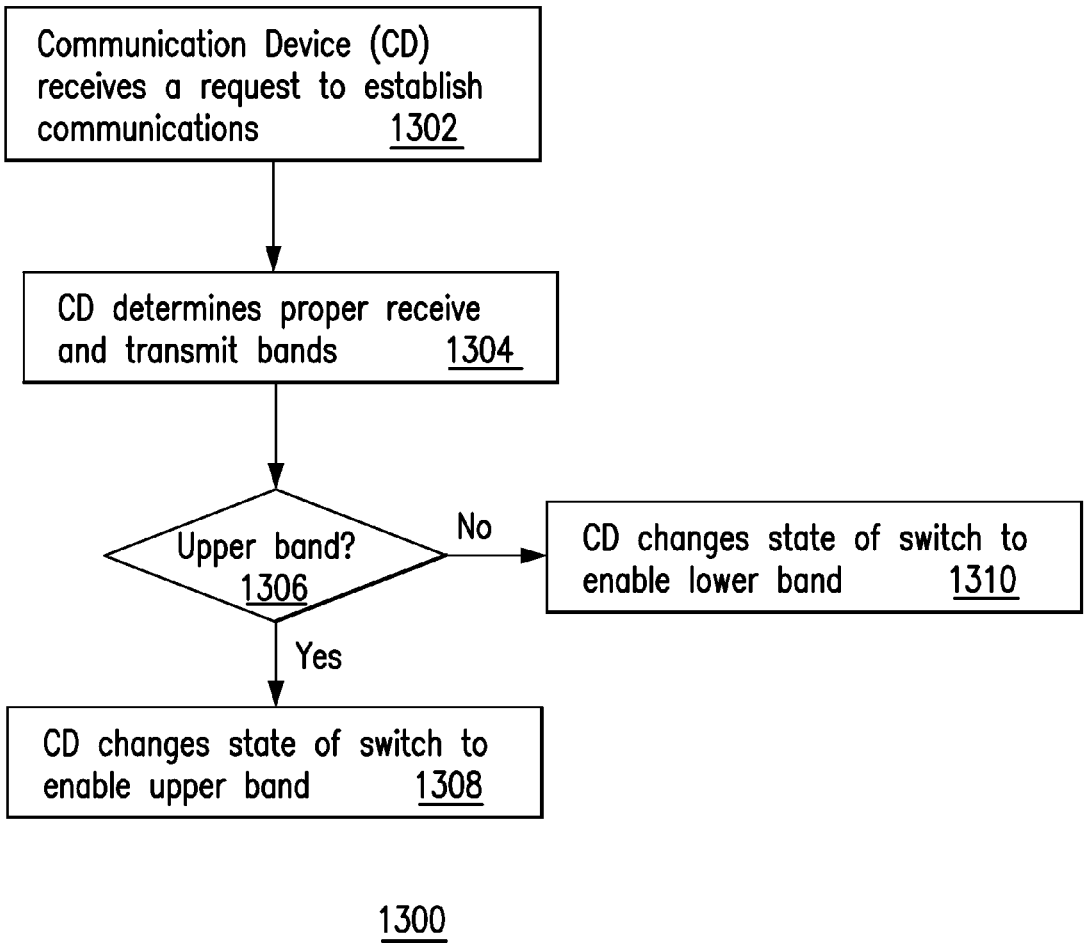
FIG. 13 depicts an illustrative embodiment of a method.

FIG. 13 depicts an illustrative embodiment of a method 1300, which can be used by the communication device 1200 of FIG. 12. Method 1300 can begin with step 1302 where the communication device 1200 receives a request to establish communications. This step can represent a user initiated request for communications such as, for example, a user dialing a phone number and selecting the send button. Depending on service provider specifications, the communication device 1200 may have several options for selecting a transmit frequency and a receive frequency for initiating communications with a base station. At step 1304 the communication device 1200 can make a determination as to which band to choose from within a low band resonance frequency range or high band resonance frequency range of the antenna. If an upper band is selected in step 1306, the communication device 1200 proceeds to step 1308 where it changes the state of a switch coupled to a primary antenna portion to enable the upper band. For low band frequency applications, step 1308 can be represented by the communication device 1200 utilizing the antenna of FIG. 2 and enabling the switching diode to the "ON" state to invoke the upper portion of the low bands as shown in FIGS. 3-5. If, on the other hand, the required transmission or receive frequency is in a lower portion of the low band region, then the communication device 1200 proceeds to step 1310 where it places the switching diode in the "OFF" state thereby invoking the lower portion of the low band region as shown in FIGS. 3-5.

Method 1200 can also be adapted for high band tuning as described in the embodiment of FIG. 11.

Upon reviewing the aforementioned embodiments, it would be evident to an artisan with ordinary skill in the art that said embodiments can be modified, reduced, or enhanced without departing from the scope of the claims described below. For example, the communication device 1200 can be a base station with multiband capabilities such as, for example, a communication device with a diversity antenna operating in multiple bands, a WiFi router, DECT device, a Bluetooth device, a ZigBee device, a cellular base station, and so on. Other embodiments can be used in the subject disclosure.

Figure 14:
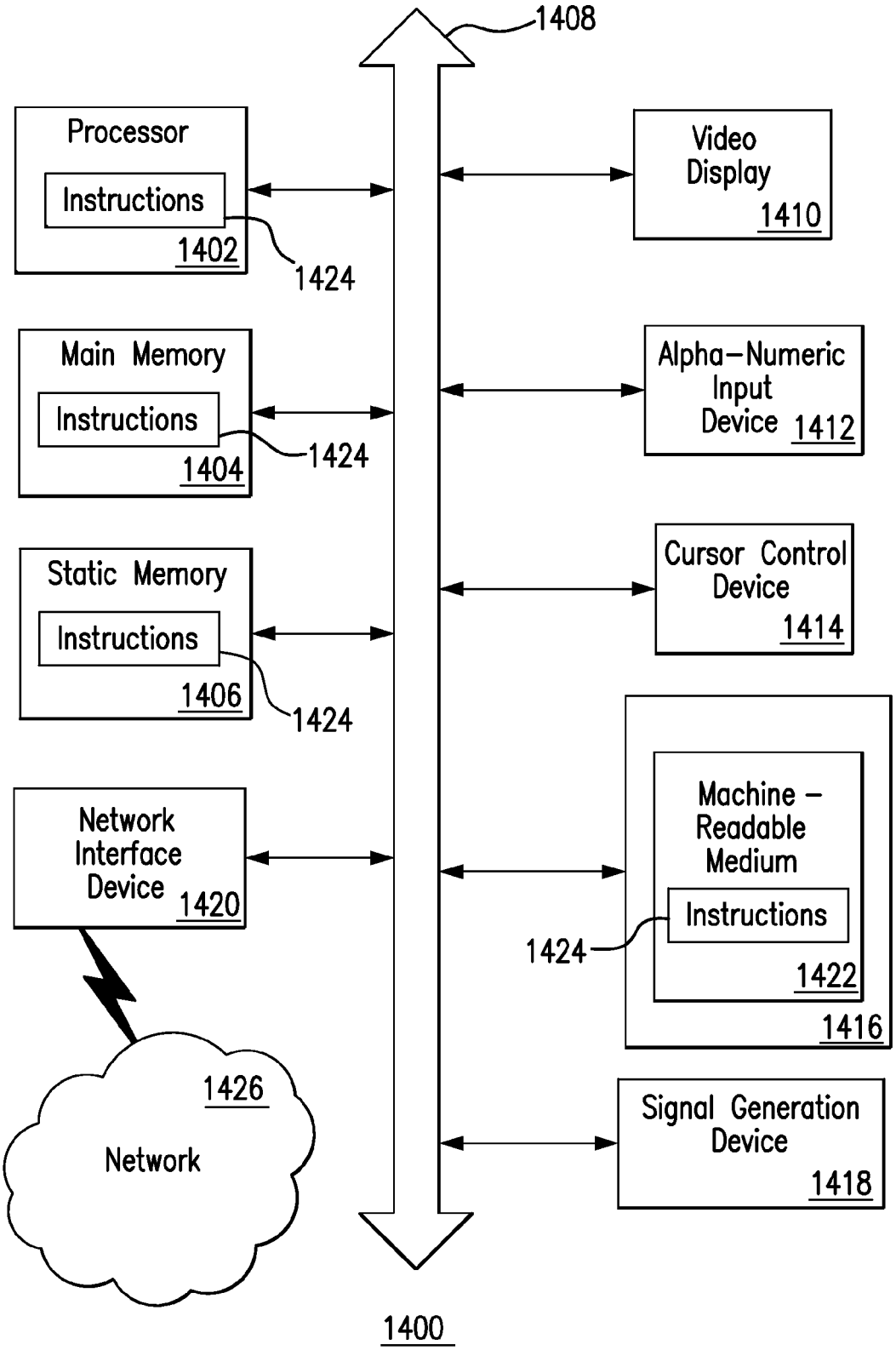
FIG. 14 is a diagrammatic representation of a machine in the form of a computer system within which a set of instructions, when executed, may cause the machine to perform any one or more of the methods described herein.

FIG. 14 depicts an exemplary diagrammatic representation of a machine in the form of a computer system 1400 within which a set of instructions, when executed, may cause the machine to perform any one or more of the methods described above. In some embodiments, the machine may be connected (e.g., using a network 1426) to other machines. In a networked deployment, the machine may operate in the capacity of a server or a client user machine in server-client user network environment, or as a peer machine in a peer-to-peer (or distributed) network environment.

The machine may comprise a server computer, a client user computer, a personal computer (PC), a tablet PC, a smart phone, a laptop computer, a desktop computer, a control system, a network router, switch or bridge, or any machine capable of executing a set of instructions (sequential or otherwise) that specify actions to be taken by that machine. It will be understood that a communication device of the subject disclosure includes broadly any electronic device that provides voice, video or data communication. Further, while a single machine is illustrated, the term "machine" shall also be taken to include any collection of machines that individually or jointly execute a set (or multiple sets) of instructions to perform any one or more of the methods discussed herein.

The computer system 1400 may include a processor (or controller) 1402 (e.g., a central processing unit (CPU), a graphics processing unit (GPU, or both), a main memory 1404 and a static memory 1406, which communicate with each other via a bus 1408. The computer system 1400 may further include a display unit 1410 (e.g., a liquid crystal display (LCD), a flat panel, or a solid state display. The computer system 1400 may include an input device 1412 (e.g., a keyboard), a cursor control device 1414 (e.g., a mouse), a disk drive unit 1416, a signal generation device 1418 (e.g., a speaker or remote control) and a network interface device 1420. In distributed environments, the embodiments described in the subject disclosure can be adapted to utilize multiple display units 1410 controlled by two or more computer systems 1400. In this configuration, presentations described by the subject disclosure may in part be shown in a first of the display units 1410, while the remaining portion is presented in a second of the display units 1410.

The disk drive unit 1416 may include a tangible computer-readable storage medium 1422 on which is stored one or more sets of instructions (e.g., software 1424) embodying any one or more of the methods or functions described herein, including those methods illustrated above. The instructions 1424 may also reside, completely or at least partially, within the main memory 1404, the static memory 1406, and/or within the processor 1402 during execution thereof by the computer system 1400. The main memory 1404 and the processor 1402 also may constitute tangible computer-readable storage media.

Dedicated hardware implementations including, but not limited to, application specific integrated circuits, programmable logic arrays and other hardware devices that can likewise be constructed to implement the methods described herein. Application specific integrated circuits and programmable logic array can use downloadable instructions for executing state machines and/or circuit configurations to implement embodiments of the subject disclosure. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the subject disclosure, the operations or methods described herein are intended for operation as software programs or instructions running on or executed by a computer processor or other computing device, and which may include other forms of instructions manifested as a state machine implemented with logic components in an application specific integrated circuit or field programmable gate array. Furthermore, software implementations (e.g., software programs, instructions, etc.) including, but not limited to, distributed processing or component/object distributed processing, parallel processing, or virtual machine processing can also be constructed to implement the methods described herein. It is further noted that a computing device such as a processor, a controller, a state machine or other suitable device for executing instructions to perform operations or methods may perform such operations directly or indirectly by way of one or more intermediate devices directed by the computing device.

While the tangible computer-readable storage medium 622 is shown in an example embodiment to be a single medium, the term "tangible computer-readable storage medium" should be taken to include a single medium or multiple media (e.g., a centralized or distributed database, and/or associated caches and servers) that store the one or more sets of instructions. The term "tangible computer-readable storage medium" shall also be taken to include any non-transitory medium that is capable of storing or encoding a set of instructions for execution by the machine and that cause the machine to perform any one or more of the methods of the subject disclosure.

The term "tangible computer-readable storage medium" shall accordingly be taken to include, but not be limited to: solid-state memories such as a memory card or other package that houses one or more read-only (non-volatile) memories, random access memories, or other re-writable (volatile) memories, a magneto-optical or optical medium such as a disk or tape, or other tangible media which can be used to store information. Accordingly, the disclosure is considered to include any one or more of a tangible computer-readable storage medium, as listed herein and including art-recognized equivalents and successor media, in which the software implementations herein are stored.

Although the present specification describes components and functions implemented in the embodiments with reference to particular standards and protocols, the disclosure is not limited to such standards and protocols. Each of the standards for Internet and other packet switched network transmission (e.g., TCP/IP, UDP/IP, HTML, HTTP) represent examples of the state of the art. Such standards are from time-to-time superseded by faster or more efficient equivalents having essentially the same functions. Wireless standards for device detection (e.g., RFID), short-range communications (e.g., Bluetooth, WiFi, Zigbee), and long-range communications (e.g., WiMAX, GSM, CDMA, LTE) can be used by computer system 1400.

It should be understood that devices described in the exemplary embodiments can be in communication with each other via various wireless and/or wired methodologies. The methodologies can be links that are described as coupled, connected and so forth, which can include unidirectional and/or bidirectional communication over wireless paths and/or wired paths that utilize one or more of various protocols or methodologies, where the coupling and/or connection can be direct (e.g., no intervening processing device) and/or indirect (e.g., an intermediary processing device such as a router).

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. The exemplary embodiments can include combinations of features and/or steps from multiple embodiments. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, can be used in the subject disclosure.

The Abstract of the Disclosure is provided with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna structure, comprising:

a primary antenna portion; and an auxiliary antenna portion, wherein the auxiliary antenna portion is coupled to the primary antenna portion by way of a current-controlled switch, wherein the current-controlled switch is coupled to a source;

wherein a portion of the primary antenna portion operates at a first resonance frequency range, wherein the current-controlled switch is coupled to the primary antenna portion and to the auxiliary antenna portion, wherein the current-controlled switch substantially forms a conduction channel between the primary antenna portion and the auxiliary antenna portion responsive to the current-controlled switch receiving from the source a unidirectional direct current or a first bias voltage having a first polarity, wherein the first resonance frequency range of the primary antenna portion is frequency shifted to a second resonance frequency range while the conduction channel is present, wherein the current-controlled switch substantially forms an open circuit between the primary antenna portion and the auxiliary antenna portion responsive to the source removing the unidirectional direct current applied to the current-controlled switch or the source applying to the current-controlled switch a second bias voltage having a second polarity, and wherein the first resonance frequency range of the primary antenna portion is restored while the open circuit is present.

2. The antenna structure of claim 1, comprising the current-controlled switch, wherein the first resonance frequency range comprises a low band frequency range or a high band frequency range.

3. The antenna structure of claim 2, comprising a capacitor, wherein the capacitor is coupled in parallel to current-controlled switch to reduce undesirable harmonics, and wherein the second resonance frequency range comprises the low band frequency range or the high band frequency range frequency shifted by an offset frequency.

4. The antenna structure of claim 1, wherein the auxiliary antenna portion electrically extends a portion of the primary antenna portion thereby causing the first resonance frequency range of the primary antenna portion to be frequency shifted to the second resonance frequency range while the conduction channel is present.

5. The antenna structure of claim 1, wherein the auxiliary antenna portion changes an inductance of a portion of the primary antenna portion thereby causing the first resonance frequency range of the primary antenna portion to be frequency shifted to the second resonance frequency range while the conduction channel is present.

6. The antenna structure of claim 1, wherein the current-controlled switch comprises a diode.

7. The antenna structure of claim 1, wherein the unidirectional direct current or the first bias voltage applied to the current-controlled switch has a magnitude that reduces a resistance of the conduction channel thereby reducing undesirable harmonics.

8. The antenna structure of claim 1, wherein the open circuit when present has a capacitance that sufficiently reduces conduction of radio frequency signals between the primary antenna portion and the auxiliary antenna portion.

9. A method, comprising:

coupling a primary antenna to an auxiliary antenna portion with a current-controlled switch;

generating a unidirectional direct current or a first bias voltage having a first polarity to cause the current-controlled switch to substantially form a conduction channel between the primary antenna and the auxiliary antenna portion, wherein a first resonance frequency range of the primary antenna is frequency shifted to a second resonance frequency range while the conduction channel is present; and removing the unidirectional direct current or generating a second bias voltage having a second polarity to cause the current-controlled switch to form an open circuit between the primary antenna and the auxiliary antenna portion, wherein the first resonance frequency range of the primary antenna is restored while the open circuit is present.

10. The method of claim 9, wherein the first resonance frequency range comprises a low band frequency range or a high band frequency range.

11. The method of claim 10, wherein the second resonance frequency range comprises the low band frequency range or the high band frequency range frequency shifted by an offset frequency.

12. The method of claim 9, wherein the auxiliary antenna portion electrically extends or changes an inductance of a portion of the primary antenna thereby causing the first resonance frequency range of the primary antenna to be frequency shifted to the second resonance frequency range while the conduction channel is present.

13. The method of claim 9, wherein the current-controlled switch comprises a semiconductor device.

14. The method of claim 9, wherein the unidirectional direct current or the first bias voltage applied to the current-controlled has a magnitude that reduces a resistance of the conduction channel thereby reducing undesirable harmonics.

15. The method of claim 9, wherein the open circuit when present has a capacitance that sufficiently reduces conduction of radio frequency signals between the primary antenna and the auxiliary antenna portion.

16. The method of claim 9, wherein the current-controlled switch comprises a diode.

17. A communication device, comprising:

an antenna structure, comprising:

a primary antenna portion;

an auxiliary antenna portion; and a switch coupled to a signal source, wherein the switch conducts only unidirectional current, and wherein the primary antenna portion is coupled to the auxiliary antenna portion by way of the switch;

a memory to store instructions; and a processor coupled to the signal source, and the memory, wherein responsive to executing the instructions, the processor performs operations comprising:

causing the signal source to generate a first signal that causes the switch to substantially form a first conduction channel between the primary antenna portion and the auxiliary antenna portion, wherein a first low band resonance frequency range of the primary antenna portion is frequency shifted to a second low band resonance frequency range while the first conduction channel is present; and causing the signal source to generate a second signal that causes the switch to form an first open circuit between the primary antenna portion and the auxiliary antenna portion, wherein the first low band resonance frequency range of the primary antenna portion is restored while the first open circuit is present.

18. The communication device of claim 17, wherein the antenna structure further comprises:

a second auxiliary antenna portion; and a second switch coupled to a second signal source, wherein a second portion of the primary antenna portion operates at a first high band resonance frequency range, wherein the second switch conducts only unidirectional current, and wherein the primary antenna portion is coupled to the second auxiliary antenna portion by way of the second switch, and wherein the processor further performs operations comprising:

causing the second signal source to generate a third signal that causes the second switch to substantially form a second conduction channel between the primary antenna portion and the second auxiliary antenna portion, wherein the first high band resonance frequency range of the primary antenna portion is frequency shifted to a second high band resonance frequency range while the second conduction channel is present; and causing the second signal source to generate a fourth signal that causes the second switch to form a second open circuit between the primary antenna portion and the second auxiliary antenna portion, wherein the first high band resonance frequency range of the primary antenna portion is restored while the second open circuit is present.

19. The communication device of claim 18, wherein the antenna structure is a multimode antenna, wherein the communication device further comprises a radio frequency transceiver coupled to the antenna structure and the processor, and wherein the processor further performs operations comprising:

causing the radio frequency transceiver to transmit or receive by way of the antenna first radio frequency signals operating in the first low band resonance frequency range while the first open circuit is present;

causing the radio frequency transceiver to transmit or receive by way of the antenna second radio frequency signals operating in the second low band resonance frequency range while the first conduction channel is present;

causing the radio frequency transceiver to transmit or receive by way of the antenna third radio frequency signals operating in the first high band resonance frequency range while the second open circuit is present; and causing the radio frequency transceiver to transmit or receive by way of the antenna fourth radio frequency signals operating in the second high band resonance frequency range while the second conduction channel is present.

20. The communication device of claim 17, wherein the switch comprises a diode.

* * * * *